US012065887B2

(12) United States Patent
Lehr

(10) Patent No.: US 12,065,887 B2
(45) Date of Patent: Aug. 20, 2024

(54) SIGNAL-TRANSPARENT TUBULAR FOR DOWNHOLE OPERATIONS

(71) Applicant: Joerg Lehr, Celle (DE)

(72) Inventor: Joerg Lehr, Celle (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/186,399

(22) Filed: Feb. 26, 2021

(65) Prior Publication Data

US 2021/0270090 A1 Sep. 2, 2021

Related U.S. Application Data

(60) Provisional application No. 62/982,320, filed on Feb. 27, 2020.

(51) Int. Cl.
*E21B 17/02* (2006.01)
*E21B 19/16* (2006.01)
(Continued)

(52) U.S. Cl.
CPC ..... *E21B 17/02* (2013.01); *E21B 19/16* (2013.01); *E21B 41/00* (2013.01); *E21B 47/13* (2020.05)

(58) Field of Classification Search
CPC ..... E21B 17/02; E21B 47/13; E21B 19/16; E21B 41/00
(Continued)

(56) References Cited

U.S. PATENT DOCUMENTS 4,683,944 A * 8/1987 Curlett ..... E21B 21/08 175/215
5,944,124 A 8/1999 Pomerleau et al.
(Continued)

FOREIGN PATENT DOCUMENTS

DE 102007028713 A1 12/2008
DE 202017102885 U1 6/2017
(Continued)

OTHER PUBLICATIONS

Leslie; "Development and Manufacture of Cost-Effective Composite Drill Pipe: Final Technical Report"; Advanced Composite Products and Technology (ACPT), Inc.; Jul. 2011; 45 pages.
(Continued)

*Primary Examiner* — Matthew Troutman
*Assistant Examiner* — Patrick F Lambe
(74) *Attorney, Agent, or Firm* — CANTOR COLBURN LLP

(57) ABSTRACT

Disclosed herein are signal-transparent and actuator-transparent tubulars for use with downhole tubular strings are. The signal-transparent tubulars include a tubular connector configured to engage with and connect to a different downhole tubular, the tubular connector formed from metal, a signal-transparent portion connected to the tubular connector, the signal-transparent portion formed from a composite material, and at least one of a sensor, an actuator, and a transmitter arranged within the signal-transparent portion and at least partially surrounded by the composite material, wherein the composite material of the signal-transparent portion is selected to be transparent to a characteristic of a signal that is detectable by or transmitted by the at least one sensor, actuator, and/or transmitter.

25 Claims, 9 Drawing Sheets

(51) Int. Cl.
*E21B 41/00* (2006.01)
*E21B 47/13* (2012.01)

(58) Field of Classification Search
USPC ..... 166/335
See application file for complete search history.

(56) References Cited

U.S. PATENT DOCUMENTS

| | | | | |
|---|---|---|---|---|
| 5,988,300 | A * | 11/1999 | Pomerleau | G01V 3/18 175/320 |
| 6,300,762 | B1 * | 10/2001 | Thomas, Jr. | E21B 47/017 324/338 |
| 7,026,813 | B2 | 4/2006 | Homan et al. | |
| 7,172,038 | B2 | 2/2007 | Terry et al. | |
| 8,287,005 | B2 | 10/2012 | Leslie et al. | |
| 9,810,028 | B2 | 11/2017 | Minosyan et al. | |
| 10,221,632 | B2 | 3/2019 | MacDonald et al. | |
| 2002/0057210 | A1 * | 5/2002 | Frey | E21B 47/017 340/854.3 |
| 2004/0040749 | A1 * | 3/2004 | Terry | E21B 17/10 175/325.1 |
| 2005/0083064 | A1 * | 4/2005 | Homan | G01V 3/28 324/347 |
| 2009/0101328 | A1 | 4/2009 | Leslie et al. | |
| 2012/0180562 | A1 * | 7/2012 | Sorbier | G01V 1/52 73/152.02 |
| 2012/0230151 | A1 | 9/2012 | Almaguer | |
| 2013/0239673 | A1 * | 9/2013 | Garcia-Osuna | G01V 9/00 324/333 |
| 2014/0368200 | A1 * | 12/2014 | Wang | G01V 3/28 324/338 |
| 2015/0315901 | A1 * | 11/2015 | Whiddon | E21B 17/00 166/380 |
| 2016/0075093 | A1 | 3/2016 | Bruehler et al. | |
| 2016/0097473 | A1 | 4/2016 | Lang et al. | |
| 2016/0097478 | A1 | 4/2016 | Bruehler et al. | |
| 2017/0269252 | A1 * | 9/2017 | Fang | E21B 49/00 |
| 2018/0148984 | A1 | 5/2018 | Logal et al. | |
| 2018/0328167 | A1 * | 11/2018 | Clarkson | G01V 3/10 |
| 2019/0353027 | A1 * | 11/2019 | Stack | B29C 48/9115 |
| 2020/0217197 | A1 * | 7/2020 | Adebiyi | E21B 49/084 |
| 2021/0131264 | A1 * | 5/2021 | Dunbar | E21B 47/007 |

FOREIGN PATENT DOCUMENTS

| | | | | |
|---|---|---|---|---|
| EP | 1158138 | A2 | 11/2001 | |
| WO | WO-2016128618 | A1 * | 8/2016 | E21B 17/042 |
| WO | 2017041955 | A1 | 3/2017 | |
| WO | 2018167462 | A1 | 9/2018 | |

OTHER PUBLICATIONS

Notification of Transmittal of the International Search Report and the Written Opinion of the International Searching Authority, or the Declaration; PCT/US2021/109944; dated Jul. 21, 2021; 11 pages.

Pizeo Element, translated to English from Wikipedia, https://de.wikipedia.org/wiki/Piezoelement; 3 pages. Page last edited: Jan. 5, 2022.

* cited by examiner

SIGNAL-TRANSPARENT TUBULAR FOR DOWNHOLE OPERATIONS

CROSS REFERENCE TO RELATED APPLICATIONS

This application claims the benefit of an earlier filing date from U.S. Provisional Application Ser. No. 62/982,320, filed Feb. 27, 2020, the entire disclosure of which is incorporated herein by reference.

BACKGROUND

1. Field of the Invention

The present invention generally relates to downhole operations and systems for having sensors distributed along a tubular string and electromagnetic telemetry of sensor data along downhole string by electrical insulation of antenna sections.

2. Description of the Related Art

Boreholes are drilled deep into the earth for many applications such as carbon dioxide sequestration, hydrogen storage, geothermal production, and hydrocarbon exploration and production. In all of the applications, the boreholes are drilled such that they pass through or allow access to a material (e.g., a gas or fluid) contained in a formation (e.g., a compartment) located below the earth's surface. Different types of tools and instruments may be disposed in the boreholes to perform various tasks and measurements.

Various sensors may be used for logging and measurements during drilling operation (e.g., measurement-while-drilling and logging-while-drilling). Such sensors may be configured to transmit and/or receive specific quantum particles and/or electromagnetic radiation to enable investigations of downhole conditions. Some such sensors may be configured to operate using certain parameters that may be impacted by the drill string itself, and thus measurements and date may be impacted by the drill string. Accordingly, it may be advantageous to reduce the impact and influence by the drill string upon measurements and sensors that are used in drilling operations.

SUMMARY

Disclosed herein are systems and methods for enabling adaptive and directional quantum particle filtering and measurement with high resolution under down hole conditions and transmitting measured data to surface with high data-rate by system embedded Electromagnetic Telemetry (EM) System. Vibration compensating and dampening elements may be embedded in the design to improve resolution of the measurements and protect drill-string and sensors against down-hole operation induced vibrations.

According to some embodiments, signal-transparent tubulars for use with downhole tubular strings are provided. The signal-transparent tubulars include a tubular connector configured to engage with and connect to a different downhole tubular, the tubular connector formed from metal, a signal-transparent portion connected to the tubular connector, the signal-transparent portion formed from a composite material, and at least one of a sensor, an actuator, and a transmitter arranged within the signal-transparent portion and at least partially surrounded by the composite material, wherein the composite material of the signal-transparent portion is selected to be transparent to a characteristic of a signal that is detectable by or transmitted by the at least one sensor, actuator, and/or transmitter.

Downhole tubular strings are defined to be part of the wellbore construction and/or part of the drill string. Parts of the wellbore construction and parts of the drill string are able to interact with each other by utilization of signal-transparent tubular technology to collect and exchange information as part of an Internet of Things (IoT) system.

According to some embodiments, signal-transparent tubulars for use with downhole tubular strings are provided. The signal-transparent tubulars include a tubular connector configured to engage with and connect to a different drilling tubular, the tubular connector formed from metal and a signal-transparent portion connected to the tubular connector, the signal-transparent portion formed from a composite material selected to be transparent to a characteristic of a sensor.

According to some embodiments, actuator-transparent tubulars for use in downhole operations are provided. The actuator-transparent tubulars include a tubular connector configured to engage with and connect to a different downhole tubular, the tubular connector formed from metal and an actuator-transparent portion connected to the tubular connector, the actuator-transparent portion formed from a composite material selected to be transparent to a characteristic of an actuator. In the context of this disclosure, an actuator is defined as a device that is configured to transmit a signal. An actuator-transparent device or material is defined as a device or material that is transparent, or at least partially transparent, with respect to a signal that is created by the actuator.

According to some embodiments, drill strings for performing downhole operations are provided. The drill strings include a plurality of drilling tubulars and a signal-transparent tubular connected to at least one drilling tubular of the plurality of drilling tubulars. The signal-transparent tubular includes a tubular connector configured to engage with and connect to the at least one drilling tubular, the tubular connector formed from metal, a signal-transparent portion connected to the tubular connector, the signal-transparent portion formed from a composite material, and a sensor arranged at least one of in or on the signal-transparent portion, wherein the composite material of the signal-transparent portion is selected to be transparent to a characteristic of the sensor.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
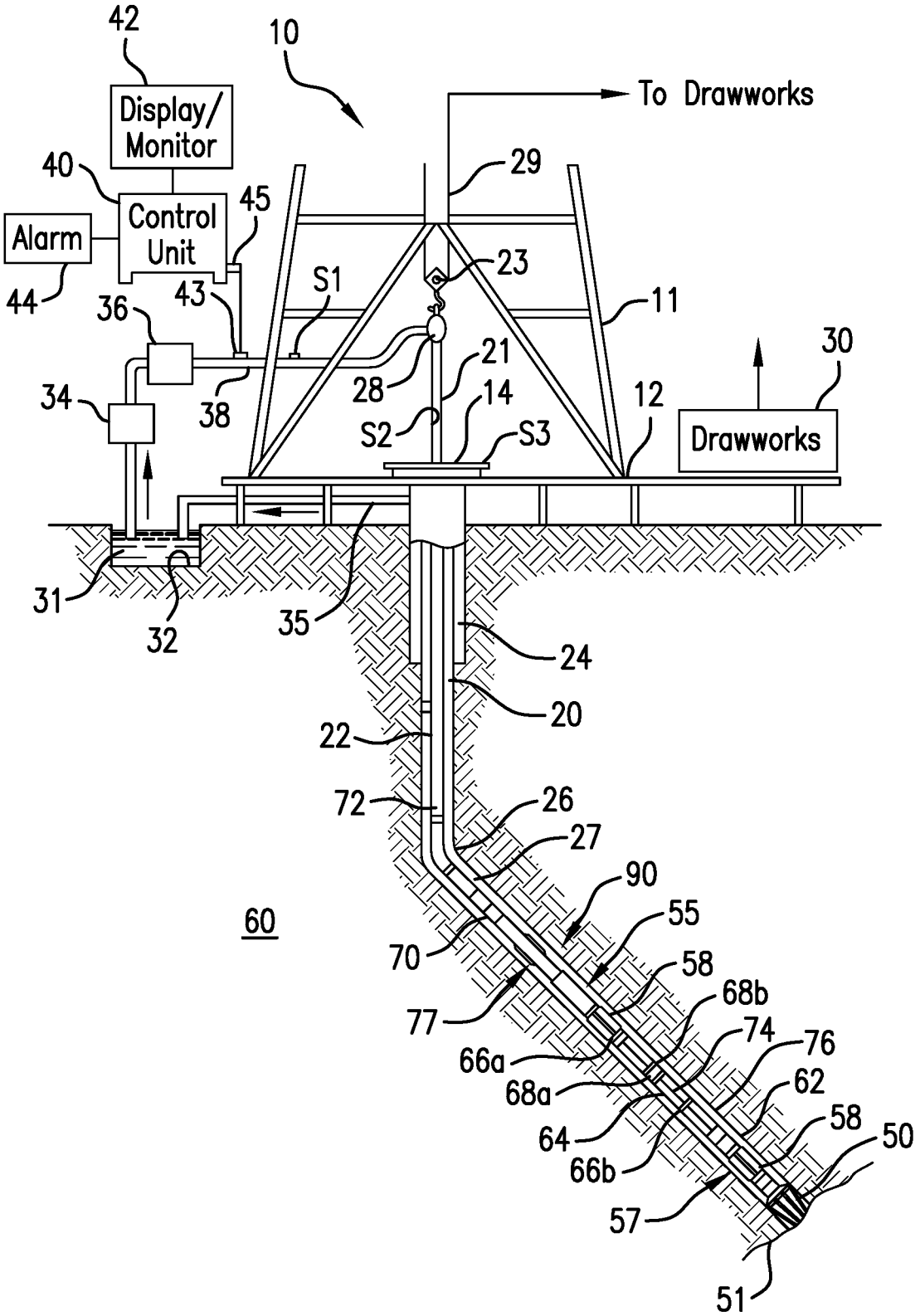
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a borehole 26 penetrating an earth formation 60. At least a portion of the borehole 26 may be stabilized with a casing 24 or a liner (not shown). The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegration device 50, such as a drill bit attached to the end of the BHA 90, disintegrates the geological formations when it is rotated to drill the borehole 26. The drill string 20 is coupled to surface equipment such as systems for lifting, rotating, and/or pushing, including, but not limited to, a drawworks 30 via a kelly joint 21, swivel 28 and line 29 through a pulley 23. In some embodiments, the surface equipment may include a top drive (not shown). During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegration device 50. The drilling fluid 31 circulates uphole through the annular space 27 between the drill string 20 and the borehole 26 and returns to the mud pit 32 via a return line 35. A sensor S1 in the fluid line 38 provides information about the fluid flow rate. A surface torque sensor S2 and a sensor S3 associated with the drill string 20 respectively provide information about the torque and the rotational speed of the drill string. Additional sensors may be configured at the surface (e.g., as part of the drilling system 10 and/or disposed downhole) and can include, without limitation, a gas tomographic sensor configured to monitor gas content and composition of the drilling fluid 31 while circulating the drilling fluid. Some such sensors may be configured with longer response times (minutes) than via detection using BHA embedded sensors and transmission via Electromagnetic Telemetry (seconds). Additionally, one or more sensors associated with line 29 are used to provide the hook load of the drill string 20 and about other desired parameters relating to the drilling of the borehole 26. The system may further include one or more downhole sensors 70 located on the drill string 20 and/or the BHA 90.

In some applications the disintegration device 50 is rotated by only rotating the drill pipe 22 from the surface. However, in other applications, a drilling motor 55 (for example, a mud motor) disposed in the drilling assembly 90 is used to rotate the disintegration device 50 and/or to superimpose or supplement the rotation of the drill string 20. In either case, the rate of penetration (ROP) of the disintegration device 50 into the earth formation 60 for a given formation and a given drilling assembly largely depends upon the weight on bit and the drill bit rotational speed. In one aspect of the embodiment of FIG. 1, the drilling motor 55 is coupled to the disintegration device 50 via a drive shaft (not shown) disposed in a bearing assembly 57. The drilling motor 55 rotates the disintegration device 50 when the drilling fluid 31 passes through the drilling motor 55 under pressure. The bearing assembly 57 supports the radial and axial forces of the disintegration device 50, the downthrust of the drilling motor and the reactive upward loading from the applied weight on bit. Stabilizers 58 coupled to the bearing assembly 57 and/or other suitable locations act as centralizers for the drilling assembly 90 or portions thereof.

One or more surface control units 40 can be configured to receive signals from the downhole sensors 70 and devices via a transducer 43, such as a pressure transducer, placed in the fluid line 38, as well as from sensors S1, S2, S3 (and other surface sensors), hook load sensors, RPM sensors, torque sensors, downhole sensors, and any other sensors used in the system and processes such signals according to programmed instructions provided to the surface control units 40. The surface control units 40 can be configured to display desired drilling parameters and other information on one or more associated display/monitor 42 for use by an operator at the rig site to control the drilling operations. The surface control units 40 may include a computer, memory for storing data, computer programs, models and algorithms accessible to a processor in the computer, a recorder, such as tape unit, memory unit, etc. for recording data and other peripherals. The surface control units 40 also may include simulation models for use by the computer to processes data according to programmed instructions. The surface control units are configured to respond to user commands entered through a suitable device, such as a keyboard. The surface control units 40 can be configured to activate alarms 44 when certain unsafe or undesirable operating conditions occur.

The drilling assembly 90 also contains other sensors and devices or tools for providing a variety of measurements relating to the formation surrounding the borehole and for drilling the borehole 26 along a desired path. Such devices may include a device for measuring the formation resistivity, conductivity, or permittivity near and/or in front of the drill bit or around the BHA 90, a gamma ray device for measuring the formation gamma ray intensity, a nuclear device for measuring nuclear radiation from the formation 60 (such as alpha-, beta-, gamma, x-ray, quantum particles) in response to radiation emitted to the formation 60 from a nuclear transmitter (not shown) included in the BHA 90, an acoustic device for measuring acoustic waves from the formation 60 in response to emitted acoustic energy to the formation 60 from an acoustic transmitter or actuator (not shown)

included in the BHA 90, an NMR device for measuring nuclear magnetic signals in response to static and dynamic magnetic fields emitted into the formation 60 from the BHA 90, and devices for determining the inclination, azimuth and position of the drill string.

Such measurement device 64, made according an embodiment described herein may be coupled at any suitable location, including above a lower kick-off subassembly or steering unit 62, for estimating or determining formation properties, such as but not limited to the resistivity of the formation near or in front of the disintegration device 50 or at other suitable locations. As another example, an inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the drilling motor 55 transfers power to the disintegration device 50 via a shaft that also enables the drilling fluid to pass from the drilling motor 55 to the disintegration device 50. In an alternative embodiment of the drill string 20, the drilling motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, temperature measurement tools, pressure measurement tools, borehole diameter measuring tools (e.g., a caliper), acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A transducer 43 placed in the fluid line 38 (e.g., mud supply line) may be configured to detect the mud pulses responsive to the data transmitted by the downhole telemetry system 72.

The transducer 43 may be configured to generate electrical signals in response to the mud pressure variations and transmits such signals via a conductor 45 to the surface control unit 40. In other aspects, any other suitable telemetry system may be used for two-way data communication (e.g., downlink and uplink) between the surface and the BHA 90, including but not limited to, an acoustic telemetry system, an electro-magnetic telemetry system, an optical telemetry system, a wired pipe telemetry system which may utilize wireless couplers or repeaters in the drill string or the borehole. The wired pipe telemetry system may be made up by joining drill pipe sections, wherein each pipe section includes a data communication link, such as a wire, that runs along the pipe. The data connection between the pipe sections may be made by any suitable method, including but not limited to, hard electrical or optical connections, induction, capacitive, resonant coupling, such as electromagnetic resonant coupling, or directional coupling methods. In case a coiled-tubing is used as the drill pipe 22, the data communication link may be run along a side of the coiled-tubing.

The drilling system described thus far relates to those drilling systems that utilize a drill pipe to convey the drilling assembly 90 into the borehole 26, wherein the weight on bit is controlled from the surface, typically by controlling the operation of the drawworks. However, a large number of the current drilling systems, especially for drilling highly deviated and horizontal boreholes, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the borehole by a suitable injector while the downhole motor, such as drilling motor 55, rotates the disintegration device 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* and/or receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegration device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Borehole, Setting a Liner and Cementing the Borehole During a Single Trip," which is incorporated herein by reference in its entirety. Importantly, despite a relatively low rate of penetration, the time of getting the liner to target is reduced because the liner is run in-hole while drilling the borehole simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, wired pipe, liner drilling, reaming, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

Drill pipe or BHAs are typically made from rigid metal materials that enables efficient transmission of torque from one pipe segment to another. Although such mechanically strong pipe or BHA segments are beneficial for drilling, such pipe or BHA materials may impact operation and efficiency of sensors and probes of a downhole system. For example, such metal pipe or BHA segments may block or otherwise interfere with sensors (e.g., transmitting-type sensors) that transmit or project energy or signals by transmitters, for example transmitters utilizing actuators, to regions outside the drilling string (i.e., into a downhole formation or borehole wall).

For example, drill pipe or BHA segments may be made of magnetic material that may interfere with magnetic sensors, such as magnetometers. As another example, drill pipe or BHA segments may be made of material that has limited transparency to signals that are sensed by the sensors. For example, drill pipe or BHA segments may be made from material that has limited transparency to electromagnetic energy (e.g., because the drill pipe or BHA segments are made of conductive material or material with high magnetic permeability), acoustic energy (e.g., because the drill pipe or BHA segments are made from material with high density), nuclear energy (e.g., because the drill pipe or BHA segments are made from material that has limited transparency to nuclear radiation), and/or NMR signals (e.g., because the drill pipe or BHA segments are made of conductive material or material with high magnetic permeability).

One potential solution is to include sections or portions of drill pipe that are transparent to such sensor properties (e.g., electromagnetic waves, nuclear radiation, static electric or magnetic fields, acoustic energy, imaging techniques, etc.). Typically, such transparent sections or portions are structurally weaker than the metallic drill pipe and thus due consideration must be made thereof. However, as described herein, structurally robust drill pipe configurations are disclosed that enable both drilling operations and efficient sensor operation. Moreover, drill pipe having signal-transparent sections or portions may be electrically isolated (e.g., non-conductive), thus eliminating such additional interference with sensor operation.

Accordingly, in accordance with some embodiments of the present disclosure, a combination of a non-magnetic drill pipe tool joints (e.g., non-magnetic metallic drill pipe tool joints), carbon fiber composites, and non-conductive glass/aramid or ceramic fiber composite drill string elements are described. Such multi-property drill pipe sections may provide for cost effective and high resolution measurements. Such measurements may be ray-type sensor measurements, including, without limitation, alpha-, beta-, gamma-, x-ray, and other quantum particle sensors, including electromagnetic radiation sensors of all amplitudes and/or frequencies, as will be appreciated by those of skill in the art. Various other sensors that may be employed with embodiments of the present disclosure includes, without limitation, acoustic sensors and NMR sensors. Embodiments described herein may be applied to measurement-while-drilling (MWD) and logging-while-drilling (LWD) applications and probes. Through the use of electric insulation, as provided by signal-transparent materials, such as non-conductive materials, electromagnetic telemetry (e.g., by means of dipole antenna gap subs) can be used. Further, embodiments described herein can provide for low weight, high flexibility to be part of the drill string, and enable high build rate applications with motors or rotary steerable systems (RSS).

Figure 2:
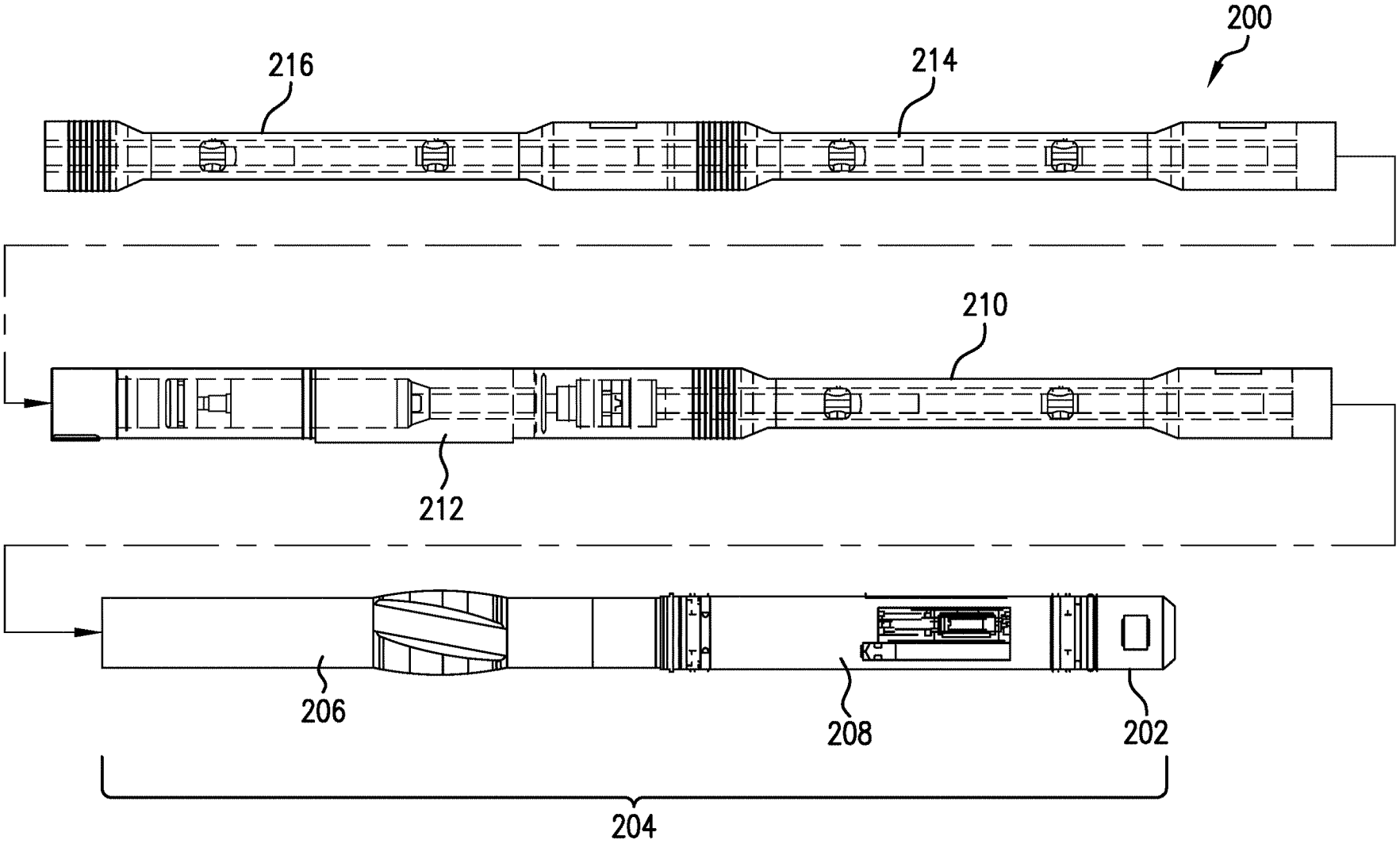
FIG. 2 is a schematic illustration of a drill string that incorporates a signal-transparent tubular in accordance with an embodiment of the present disclosure.

Turning now to FIG. 2, a schematic illustration of a drill string 200 in accordance with an embodiment of the present disclosure is shown. The drill string 200 may be used in a drilling system, such as shown and described with respect to FIG. 1. The drill string 200 includes a disintegrating device such as a drill bit 202 at a distal or bottom hole end of the drill string 200. The drill bit is part of a bottomhole assembly 204, which, as shown, includes an electronics sub 206 and a steering sub 208. Uphole from the bottomhole assembly 204 is a signal-transparent tubular 210, a power and electronics sensor sub 212, a telemetry sub 214, and a metallic drill pipe 216.

In some embodiments, the signal-transparent tubular 210, the electronics sensor sub 212, and the telemetry sub 214 may be part of the bottomhole assembly 204, which is disposed on an end of a series of metallic drill pipes 216, as will be appreciated by those of skill in the art. In some embodiments, two or more signal-transparent tubulars 210 may be included in the drill string 200 and/or the BHA 204 where they can be used to house sensors or provide for telemetry means as described in more detail herein.

In this illustrative embodiment, the signal-transparent tubular 210 is configured from multiple materials to provide for sensor-transparency and flexibility. The second sensor sub 212 may be a metallic sub, with one or more probes or other types of sensors that may not be impacted by a metallic housing. In some embodiments, the signal-transparent tubular 210 and/or the sensor sub 212 may include electronics or other control elements, as will be appreciated by those of skill in the art. The telemetry sub 214 may be configured for communication by telemetry to/from the surface of information and/or commands. In some embodiments, the metallic drill pipe 216 may be configured to operate or function as a telemetry antenna.

The signal-transparent tubular 210 may be configured with tubular connectors to enable connection to the sensor sub 212 uphole of the signal-transparent tubular 210 and to a portion of the bottomhole assembly 204 (e.g., to the electronics sub 206 or the steering sub 208) located downhole from the signal-transparent tubular 210. Between the tubular connectors, one or more signal-transparent materials is used to form a sensor housing that is, at least partially, transparent to a signal that a sensor of the signal-transparent tubular 210 is configured to detect (e.g., transparent to radiation or transmissions from transmitters or actuators of the sensor sub or received by the sensors of the sensor sub). The signal-transparent tubular 210 can include one or more sensors installed or arranged within an interior of the sub (i.e., housed within a housing) and/or embedded within the material of the sub structure (i.e., embedded within a material of the housing).

The signal-transparent tubular 210 may be made from, at least partially, a strong, non-conducting, non-magnetic, and/or otherwise signal-transparent material. The strength allows the signal-transparent tubular 210 to be used within the drill string 200 during drilling operations. That is, the strength of the signal-transparent tubular 210 allows for the transmission of weight and/or torque from an uphole side of the signal-transparent tubular 210 to a downhole side of the signal-transparent tubular 210. Further, the non-conducting nature of the material of the signal-transparent tubular 210 can provide for an electromagnetic break, isolation, and/or separation between uphole and downhole elements relative to the signal-transparent tubular 210. Finally, the signal-transparent material enables efficient sensor use and operation within the signal-transparent tubular 210, without interference, attenuation, or blocking of signals. Interference, attenuation, or blocking of signals may be present in typical metallic subs or sections of drill pipe. As referred to herein, the signal-transparent tubular 210 may be a modified drilling tubular that is part of the drill string 200, and thus is not merely a typical electronics or other sub or module of a bottomhole assembly.

As such, the signal-transparent tubular 210 is a section of the drill string 200 that includes sensors or transmitters/actuators and a portion of the signal-transparent tubular 210 is transparent to energy or a signal that the specific sensor is configured to detect (e.g., EM radiation, acoustic, alpha-, beta-, gamma, x-ray, quantum particles, etc.). Electric insulation of the drilling tubular that is the signal-transparent tubular 210 enables utilization of composite drill pipe for Electromagnetic Telemetry (Dipole Antenna Gap Sub). Further, such composite drilling tubular enables low weight at high flexibility of the drill string for high build rate applications with motors or rotary steerable systems (RSS).

In some embodiments, tubular connectors on opposite ends of the signal-transparent tubular 210 may be made from high strength magnetic or non-magnetic steel (or other metal). These tubular connectors enable engagement with other sections of the drill string, such as by Standard API thread tool joint or customized connections, as will be appreciated by those of skill in the art.

In accordance with some embodiments, a portion of the signal-transparent tubular 210 is made from an extreme high strength composite material that is rigid and sufficient to withstand high clamping and bending loads at clamping elements of the tubular connectors. This portion may be referred to as a high-strength portion of the signal-transparent tubular. Such composite material, in some embodiments, may be low transparent or non-transparent to a sensor characteristics (e.g., a specific wavelength, acoustic waves, electric sensing, quantum particles, etc.). A signal-transparent middle section may be connected to the high strength composite material section by a mixed and woven transition zone of electrical-conductive-low-ray-transparent extreme high mechanical strength fiber (e.g., carbon fiber) and electrical-non-conductive-high-ray-transparent high mechanical strength fiber (e.g. glass fiber).

In accordance with some embodiments, a portion of the signal-transparent tubular is made from a composite material that is rigid and sufficient to operate as a section of drilling tubular during operation (i.e., can transmit torque and weight and is subject to various downhole conditions and drilling conditions, such as vibrations, rotations, temperatures, drilling fluids, etc.), but is also transparent to a sensor characteristics (e.g., wavelength, acoustic energy, quantum particles, etc.). In some non-limiting embodiments, this signal-transparent portion of the signal-transparent tubular may have a reduced diameter as compared to the tubular connectors and/or the high strength portions of the signal-transparent tubular. In other embodiments, the diameter of the signal-transparent portion may be the same diameter or have a larger diameter than the tubular connectors and/or the high-strength portion (e.g., a geometry of a 3-pad stabilizer).

In addition to the primary portions of the signal-transparent tubular (i.e., signal-transparent portion, high-strength portion, and tubular connectors), additional portions can be optionally provided for engagement between the different primary portions. For example, a clamp assembly may be arranged between the signal-transparent portion and the high-strength portion and/or between the high-strength portion and the tubular connectors. Additionally, in some embodiments, multiple different signal-transparent portions may be arranged along the signal-transparent tubular, with connections between such different portions.

The signal-transparent portions can include one or more sensors. In some configurations, the sensors may be embedded within a composite material of the signal-transparent portion. In some embodiments, alternatively or in combination with embedded configurations, one or more sensor modules can be arranged within the signal-transparent portion (i.e., housed within the signal-transparent portion). In some embodiments, whether embedded or housed, the signal-transparent portion can include "windows" of specific transparent material that are transparent to specific sensors or properties of sensors of the signal-transparent portion.

Electrical wiring and/or connections can be embedded within the various portions of the multi-part drilling tubular, and may be configured to electrically connect the sensors, sensor elements, and/or other electronics of the signal-transparent tubular. Further, in some embodiments, electrical connections may be arranged to extend from one tubular connector to another, thus allowing electrical connection to portions of a drill string both above and below the signal-transparent tubular, while maintaining a substantially electrically isolated signal-transparent tubular.

Figure 3:
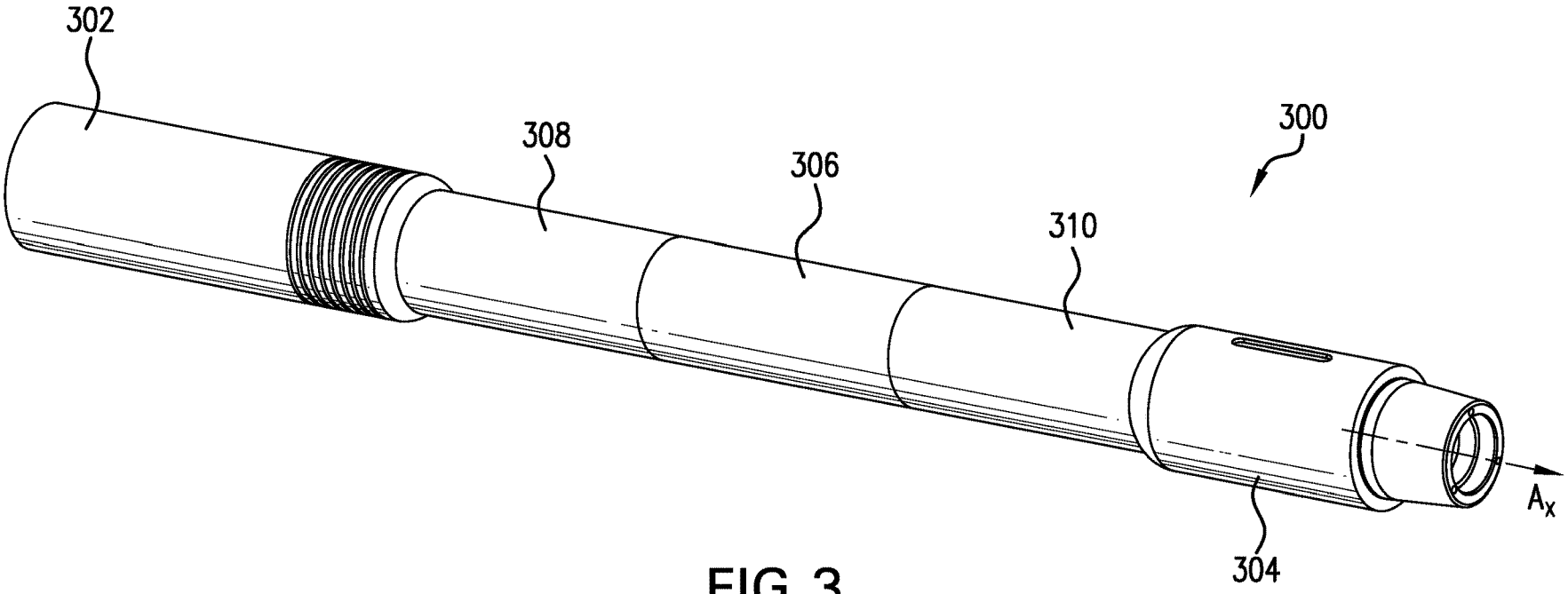
FIG. 3 is a schematic illustration of a signal-transparent tubular in accordance with an embodiment of the present disclosure.

Turning now to FIG. 3, a schematic illustration of a signal-transparent tubular 300 in accordance with an embodiment of the present disclosure is shown. The signal-transparent tubular 300 may be a drilling tubular (e.g., the drilling tubular 22 shown in FIG. 1), a casing (e.g., the casing 24 shown in FIG. 1), a liner, or other type of downhole tubular, or a segment of any of these as will be appreciated by those of skill in the art.

For example, the signal-transparent tubular 300 shown in FIG. 3 may be arranged along a drill string that is used for drilling operations in subsurface formations. That is, in some embodiments, the signal-transparent tubular 300 may be arranged along a drill string or bottomhole assembly as shown in FIG. 1 and be one of the drilling tubulars discussed with respect thereto. In some embodiments, the signal-transparent tubular 300 may be arranged above (uphole from) a bottomhole assembly of a drill string.

The signal-transparent tubular 300 includes a first tubular connector 302 and a second tubular connector 304 arranged at opposite ends of the signal-transparent tubular 300. The first tubular connector 302 may be configured to connect to a different downhole tubular or bottomhole assembly segment of a downhole string (e.g., a metallic drill string tubular) on a first side or end of the signal-transparent tubular 300 and the second tubular connector 304 may be configured to connect to a different downhole tubular or bottomhole assembly segment of a drill string on a second side or send of the signal-transparent tubular 300. Between the first tubular connector 302 and the second tubular connector 304 is a signal-transparent portion 306. The signal-transparent portion 306 is connected to the first drilling connector 302 by a first high-strength portion 308 toward the first end and to the second drilling connector by a second high-strength portion 310 toward the second end of the signal-transparent tubular 300.

In some non-limiting embodiments, the first and second tubular connectors 302, 304 may be formed from a non- or low-magnetic/non- or low-conducting material (e.g., austenitic stainless steel or titanium). For example, the first and second tubular connectors 302, 304 may be formed from a material with a magnetic permeability close to 1, for example, below 10, such as below 5 or even 2 (e.g., a permeability below 1.5). In such embodiments, such materials of the first and second tubular connectors 302, 304 can ensure magnetic isolation of the signal-transparent tubular 300.

Further, the materials of the high-strength portions 308, 310 and the signal-transparent portion 306 may be made from non- or low-magnetic/non- or low-conducting materials. For example, the high-strength portions 308, 310 may be formed from a material with a magnetic permeability close to 1, for example below 10, such as below 5 or even 2 (e.g., below 1.5). For example, the high-strength portions 308, 310, in some embodiments, may be formed from carbon-based materials (e.g., carbon fiber composites) or non-carbon materials. Further, for example, in some embodiments, the signal-transparent portion 306 may be formed from signal-transparent materials, such as polyether ketone ketones or polyether ether ether ketones (PEKK, PEEK), high strength aluminum, titanium, synthetic fiber composites, including, without limitation, ceramic, glass, aramids, basalt fibers, fibers embedded in epoxide or polyether ketones, multilayer titanium sleeve/synthetic fiber composites, anodized titanium mesh/synthetic fiber composites, electrical low conductive fiber composites, embedded in electrical low conductive adhesives, thermoset, thermoplastic or elastomeric binder, etc.

In this illustrative embodiment, the signal-transparent portion 306 is a cylindrical section or portion of the signal-transparent tubular 300. That is, the entire signal-transparent portion 306 can provide a 360° angle of transparency, about an axis $A_x$ of the signal-transparent tubular 300 (i.e., in a radial direction relative to the axis $A_x$). The signal-transparent portion 306 is connected or otherwise attached at both ends, in the axial direction, to the first and second high-strength portions 308, 310. The connection may be by woven composite fibers of different materials, clamps, fasteners, bonding, welding, threads, interference fits, combinations thereof, and/or other connectors/fasteners and mechanisms as will be appreciated by those of skill in the art. In some embodiments, the connection between the signal-transparent portion 306 and the first and second high-strength portions 308, 310 may be determined or based on the selection of materials that are used to form the various portions.

Advantageously, as shown in FIG. 3, the high portions 306, 308, 310 may have an outer diameter that is smaller than the outer diameter of the first and second tubular connectors 302, 304. As these components/structures (e.g., the portions 306, 308, 310 and the first and second tubular connectors 302, 304) may have varying diameters (not shown), a maximum and a minimum outer diameter may be defined for each of the portions 306, 308, 310 as well as the first and second tubular connectors 302, 304. In such configurations with variable outer diameters, the portions 306, 308, 310 may have a maximum or a minimum outer diameter that is smaller than the maximum outer diameter of the first and second tubular connectors 302, 304. In one embodiment, one or both of the tubular connectors 302, 304 may be configured, arranged, and/or shaped to act as a stabilizer to guide and stabilize the signal-transparent tubular 300 within the borehole. In an alternate embodiment, the portions 306, 308, 310 may have an outer diameter that is larger than the outer diameter of the first and second tubular connectors 302, 304. The first and second tubular connectors 302, 304 also may have a maximum or a minimum outer diameter that is smaller than the maximum outer diameter of the portions 306, 308, 310. In one embodiment, one or more of the portions 306, 308, 310 may be configured, arranged, and/or shaped to act as a stabilizer to guide and stabilize the signal-transparent tubular 300 within the borehole.

The material of the signal-transparent portion 306 may be selected to be transparent to one or more types of sensors. For example, the material may be selected to be transparent to a single quantum particle type and/or specific frequency band (e.g., quarks, leptons, bosons, x-rays, gamma rays, alpha rays, beta rays, electromagnetic radiation of any amplitude and frequency, acoustic energy, static magnetic or electrical fields, and/or other radiation) or to multiple types of quantum particles, radiation, and/or other signals. The sensors used to emit and receive such quantum particles may be housed within the signal-transparent portion 306, such as within a sensor module that is arranged under/inside the material of the signal-transparent portion 306. That is, in some embodiments, the signal-transparent portion 306 may be a hollow cylinder that forms part of the signal-transparent tubular 300 and can have a sensor module installed therein. Further, the signal-transparent portion 306 (along with the high-strength portions 308, 310 and the tubular connectors 302, 304) may define an interior fluid path for allowing drilling fluid or other fluid therethrough.

In some embodiments, one or more of the portions 306, 308, 310 may have a low mass density (e.g., a lower mass density than steel or a lower mass density than the tubular connectors 302, 304) and/or a low stiffness (e.g., a lower stiffness than steel or a lower stiffness than the tubular connectors 302, 304). For example, polyether ketone ketones or polyether ether ether ketones (PEEK, PEKK), high strength aluminum, titanium, synthetic fiber composites, including, without limitation, ceramic, glass, aramids, basalt fibers, fibers embedded in epoxide or polyether ketones, multilayer titanium sleeve/synthetic fiber composites, anodized titanium mesh/synthetic fiber composites, electrical low conductive fiber composites, embedded in electrical low conductive adhesives, thermoset, thermoplastic or elastomeric binder, etc. all have a lower mass density and/or a lower stiffness than steel. In such configurations, the signal-transparent tubular 300 may act as a damping element or isolator to damp or isolate vibrations downhole (e.g., damp lateral, axial, or torsional oscillations, such as high-frequency torsional oscillations, also known as HFTO, such as torsional oscillations above 30 Hz or 50 Hz) more effectively than the same sub would do if it was made from a metal, such as steel. Damping or isolating vibrations and/or oscillations downhole helps to increase lifetime of downhole equipment and the same time increase accuracy and precision of sensors installed in the BHA that would otherwise suffer from vibrations and/or oscillations.

Figure 4:
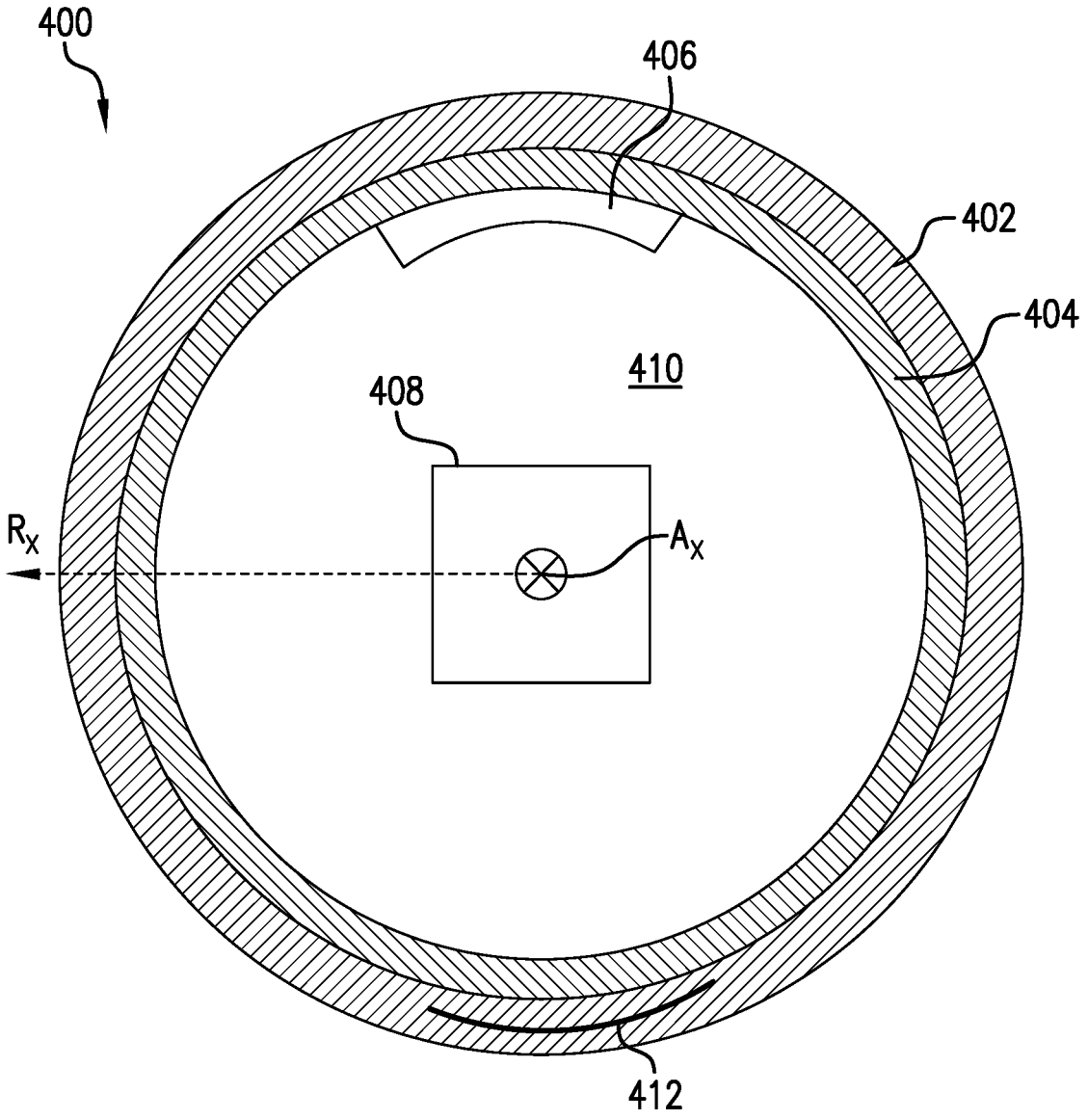
FIG. 4 is a cross-sectional illustration of a portion of a signal-transparent tubular in accordance with an embodiment of the present disclosure.

Turning now to FIG. 4, a schematic cross-sectional view of a portion of a signal-transparent tubular 400 in accordance with an embodiment of the present disclosure is shown. The signal-transparent tubular 400 may be similar to that shown in FIG. 3, and may be representative of a drilling tubular, a liner, a casing, or other downhole tubular, as will be appreciated by those of skill in the art. The signal-transparent tubular 400 includes a signal-transparent portion 402 that is part of the signal-transparent tubular 400. The signal-transparent portion 402 is formed of a material to be transparent to one or more signals that may be generated by a transmitter/actuator and/or received by a sensor 404 (e.g., quantum sensor) housed or arranged within the signal-transparent portion 402. Further, the material of the signal-transparent portion 402 may be selected to withstand the conditions (e.g., temperatures, pressures, vibration, weight, torque, etc.) of downhole operations, and thus protect the sensors arranged therein. The material of the signal-transparent portion 402 may be selected to carry mechanical load (e.g., on titanium tubular surface embedded Charted Coupled Device-Arrays (CCDs)).

In this illustrative embodiment, the signal-transparent tubular 400 includes a variety of different configurations of sensors installed or arranged therein. Although shown in a specific arrangement in FIG. 4, those of skill in the art will appreciate that various combinations or single sensors and/or different arrangements/configurations may be employed without departing from the scope of the present disclosure. That is, the illustration and arrangement of FIG. 4 is merely to be illustrative and not to be limiting. In this illustrative embodiment, the signal-transparent tubular 400 includes three different types of sensors installed within the signal-transparent portion 402.

As shown, a first sensor 404 is arranged as an annular structure that is mounted or otherwise positioned within or on an interior surface of the signal-transparent portion 402. The first sensor 404 may extend a full axial length of the signal-transparent portion 402 in an axial direction $A_x$. The first sensor 404 may be configured to transmit and/or receive one or more types of signals through the material of the signal-transparent portion 402 in a radial direction R. The radial direction Rx may be a direction toward a formation that the signal-transparent tubular 400 is passing through.

Alternatively, or in addition, a second sensor 406 is arranged similarly as the first sensor 404 but is a partial annular structure that does not extend over an entire circumference of the signal-transparent portion 402. In some configurations, the partial-annular second sensor 406 may be directly attached, mounted, or positioned relative to the material of the signal-transparent portion 402, and the present illustration is merely for explanatory purposes.

Alternatively, or in addition, a third sensor 408 is arranged within a flow path 410 of the signal-transparent tubular 400 and within the signal-transparent portion 402 such that a fluid flowing through a flow path 410 (e.g., substantially axial direction) flows around the third sensor 408 (e.g., in the space between the signal-transparent portion 402 and the third sensor 408). The third sensor 408 may be part of a sensor module that is mounted or arranged within the signal-transparent portion 402 as will be appreciated by those of skill in the art. In some such embodiments, a drilling fluid may flow through the flow path 410 and around the third sensor 408.

Alternatively, or in addition, a fourth sensor 412 is arranged within or fully surrounded by the material of the signal-transparent portion 402. The signal-transparent portion 402 may include the fourth sensor 412 installed or arranged within the signal-transparent portion 402 (e.g., housed within the signal-transparent portion 402) and/or in direct contact with the material of the signal-transparent portion 402 (e.g., in direct contact with the signal-transparent and composite material).

The fourth sensor 412 may only be partially in direct contact with the material of the fourth sensor 412 (e.g., only portions of the fourth sensor 412 may be in direct contact with the material of the signal-transparent portion 402) or the fourth sensor 412 may be completely in direct contact with the material of the signal-transparent portion 402 (e.g., in direct contact with the composite material of the signal-transparent portion 402). In some embodiments, no portion of one or more surfaces of the fourth sensor 412 may be in contact with anything but the material of the sub structure (e.g., the composite material of the sub structure). The signal-transparent portion 402 can include the fourth sensor 412 embedded within the material of the sub structure (e.g., embedded within a material of the housing). That is, in some embodiments, the fourth sensor 412 may be fully embedded within the material of the signal-transparent portion 402.

Figure 5:
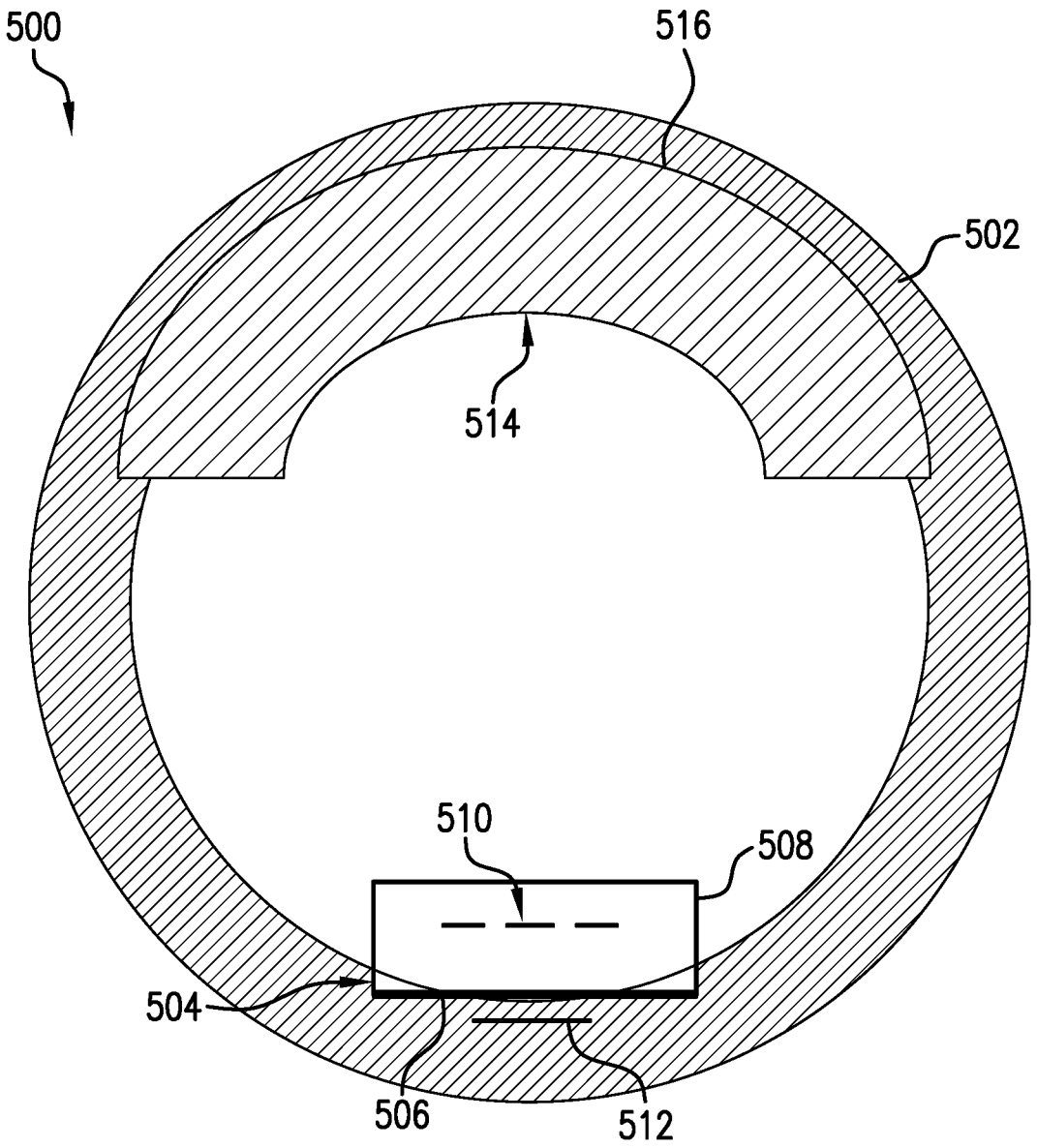
FIG. 5 is a cross-sectional illustration of a portion of a signal-transparent tubular in accordance with an embodiment of the present disclosure.
Figure 6:
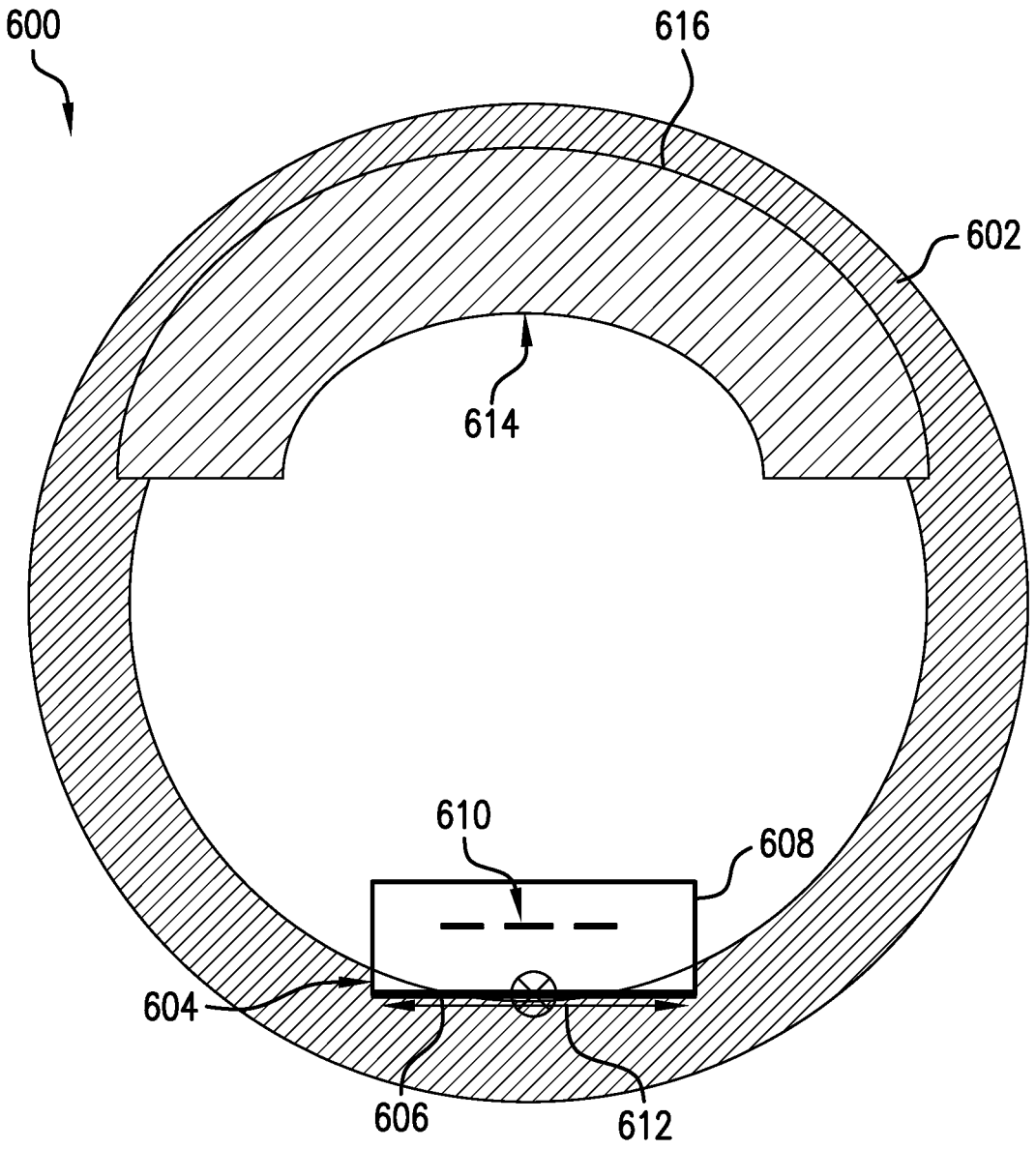
FIG. 6 is a cross-sectional illustration of a portion of a signal-transparent tubular in accordance with an embodiment of the present disclosure.

Turning now to FIGS. 5-6, variations and/or alternative configurations of signal-transparent tubulars in accordance with an embodiment of the present disclosure are shown. Such configurations utilize materials that may not be as transparent as some materials but may provide for additional features. For example, in some such embodiments, the signal-transparent tubular may be formed from a high density material, such as tungsten or lead. In such embodiments, a quantum mirror or mirror for electromagnetic or acoustic waves may be employed to improve direction resolution of quantum sensors.

In some embodiments, the quantum sensors may have a length of 1 meter or more, for example, and may enable high resolution of formation properties and can be used to derive 3D images of a formation, including, for example, direction chemical composition maps. Optionally, the use of double gap or multi-gap (x-gap) screens between a source and/or quantum mirror can enable quantum spectroscope measurements.

Turning to FIG. 5, a schematic cross-sectional view of a portion of a signal-transparent tubular 500 in accordance with an embodiment of the present disclosure is shown. The signal-transparent tubular 500 may be similar to that shown in FIG. 3, and may be representative of a drilling tubular, a liner, a casing, or other downhole tubular, as will be appreciated by those of skill in the art. The signal-transparent tubular 500 includes a signal-transparent portion 502 that is part of the signal-transparent tubular 500. The signal-transparent portion 502 is formed of a material to be transparent to one or more quantum particles or other electromagnetic radiation and/or to acoustic or nuclear radiation that may be generated by transmitters/actuators (not shown) and/or received by a sensor 504 housed or arranged within the signal-transparent portion 502. Further, the material of the signal-transparent portion 502 may be selected to withstand the conditions (e.g., temperatures, pressures, etc.) of downhole operations, and thus protect the sensors arranged therein. The material of the signal-transparent portion 502 may be selected to carry mechanical load (e.g., on titanium tubular surface embedded Charted Coupled Device-Arrays (CCDs)).

In this embodiment, the sensor 504 includes a quantum sensor array 506. As used herein, the word "quantum" is used and understood in a broad meaning and includes any transferred energy which is known to be transferred in energy quanta, such as, but not limited to, nuclear energy, electromagnetic energy, acoustic energy, etc. In one non-limiting example, the quantum sensor array 506 may be configured as a 1-meter length multi-quantum sensor array. The sensor 504 further includes a crystal 508 arranged relative to the quantum sensor array 506 and a double or x-gap screen 510 may formed or present within the crystal 508.

In some embodiments, a quantum backing shield 512 may be arranged opposite the crystal 508 relative to the quantum sensor array 506. To focus quantum radiation and/or particles to the quantum sensor array 506, a quantum mirror 514 is arranged on an opposing side of the signal-transparent portion 502 and arranged to reflect and direct quantum radiation and/or particles to the quantum sensor array 506 through the crystal 508. The quantum mirror 514 also includes a respective quantum backing shield 516.

Turning now to FIG. 6, a schematic cross-sectional view of a portion of a signal-transparent tubular 600 in accordance with an embodiment of the present disclosure is shown. The signal-transparent tubular 400 may be similar to that shown in FIG. 3, and may be representative of a drilling tubular, a liner, a casing, or other downhole tubular, as will be appreciated by those of skill in the art. The signal-transparent tubular 600 includes a signal-transparent portion 602 that is part of the signal-transparent tubular 600.

The signal-transparent portion 602 is formed of a material to be transparent to one or more quantum particles including electromagnetic, nuclear, or acoustic radiation that may be generated by and/or received by a sensor 604 housed or arranged within the signal-transparent portion 602. Further, the material of the signal-transparent portion 602 may be selected to withstand the conditions (e.g., temperatures, pressures, vibrations, loads, etc.) of downhole operations, and thus protect the sensors arranged therein. The material of the signal-transparent portion 502 may be selected to carry mechanical load (e.g., on titanium tubular surface embedded Charted Coupled Device-Arrays (CCDs)).

In this embodiment, the sensor 604 includes a quantum sensor array 606. In one non-limiting example, the quantum sensor array 606 may be configured as a 1-meter length multi-quantum sensor array. The sensor 604 further includes a crystal 608 arranged relative to the quantum sensor array 606 and a double or x-gap screen 610 may formed or present within or attached to the crystal 608. In this embodiment, an actuator 612 is provided and configured for adaptive movement of the quantum sensor array 606. The actuator 612 may be a piezo-actuator, a high frequency electromagnet, a bio-actuator, or other type of actuator as will be appreciated by those of skill in the art.

To focus quantum radiation and/or particles to the quantum sensor array 606, a quantum mirror 614 is arranged on an opposing side of the signal-transparent portion 602 and arranged to reflect and direct quantum radiation and/or particles to the quantum sensor array 606 through the crystal 608. The quantum mirror 614 also includes a respective quantum backing shield 616 to shield quantum energy from the quantum sensor array 606 from at least a part of the circumference of the transparent tubular 600. As shown, the quantum mirror 614 and the quantum backing shield 616 may be made of one material to provide both shielding in one direction and focusing into another direction (e.g., the opposite direction).

In some non-limiting configurations, the actuators 612 may be configured to generate power. For example, in a drill string configuration, the actuator 612 may be a piezo-actuator that is configured to convert vibrations and mechanical energy into electricity, which may be used to power the quantum sensor components. Similarly, different types of actuators may be configured to convert fluid flow, temperature differentials, mechanical motion, etc. into electrical power which can be used to power the sensors and related electronics and/or distributed to other downhole electrical systems.

Figure 7:
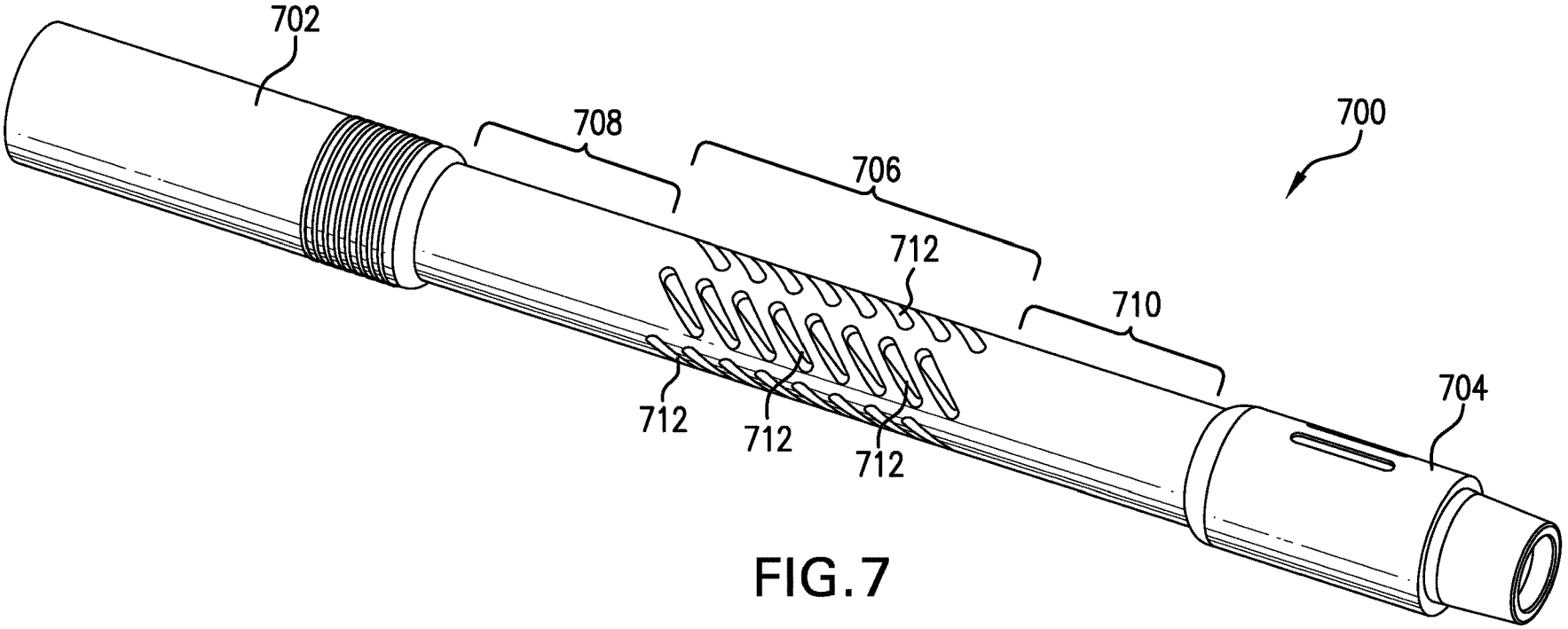
FIG. 7 is a schematic illustration of a signal-transparent tubular in accordance with an embodiment of the present disclosure.

Turning now to FIG. 7, a schematic illustration of a signal-transparent tubular 700 in accordance with an embodiment of the present disclosure is shown. The signal-transparent tubular 700 may be arranged along a drill string that is used for drilling operations in subsurface formations. For example, the signal-transparent tubular 700 may be arranged along a drill string as shown in FIG. 1 and may be one of the drilling tubulars discussed with respect thereto. In some embodiments, the signal-transparent tubular 700 may be arranged above (uphole from) a bottomhole assembly of a drill string. In other embodiments, the signal-transparent tubular 700 may be a section of liner or casing that is disposed downhole, or may be a portion or section of any other type of downhole tubular, as will be appreciated by those of skill in the art.

The signal-transparent tubular 700 includes a first tubular connector 702 and a second tubular connector 704 arranged at opposite ends of the signal-transparent tubular 700. The first tubular connector 702 may be configured to connect to a another downhole tubular of a downhole string (e.g., a metallic drill string tubular) or a segment of a bottomhole assembly (e.g., a metallic bottomhole assembly segment) on a first side or end of the signal-transparent tubular 700 and the second tubular connector 704 may be configured to connect to a drilling tubular or bottomhole assembly segment of a drill string on a second side or end of the signal-transparent tubular 700. Between the first tubular connector 702 and the second tubular connector 704 is a signal-transparent portion 706, a first high-strength portion 708, and a second high-strength portion 710. The first high-strength portion 708 connects at a first end to the first tubular connector 702 and the second high-strength portion 710 connects at a second end to the second tubular connector 704.

Similar to that described above, the first and second tubular connectors 702, 704 may be formed from a non- or low-magnetic/non- or low-conducting material (e.g., austenitic stainless steel). For example, the first and second tubular connectors 702, 704 may be formed from material with a magnetic permeability close to 1, for example, below 10, such as below 5 or even 2 (e.g., below 1.5). Alternatively, or in addition, one or more of the signal-transparent portion 706 and the high-strength portions 708, 710 may be formed from a non- or low-magnetic/non- or low-conducting material (e.g., a composite material). For example, the signal-transparent portion 706 and the high-strength portions 708, 710 may be formed from material with an electric conductivity that is lower than that of steel, such as 100, 1,000, or 10,000 times lower electric conductivity than that of steel. In such embodiments, such materials of the first and second tubular connectors 702, 704 can ensure magnetic and/or electric isolation of the signal-transparent tubular 700.

In this embodiment, as illustratively shown, the signal-transparent portion 706, the first high-strength portion 708, and the second high-strength portion 710 are substantially unitary. That is, the material of that forms the high-strength portions 708, 710 extends substantially uninterrupted between the first tubular connector 702 and the second tubular connector 704. The signal-transparent portion 706 is that substantially part of the high-strength portion of the signal-transparent tubular 700. In this illustrative embodiment, the signal-transparent portion 706 includes one or more signal-transparent windows 712. The signal-transparent windows 712 may be elements of signal-transparent material that is embedded into the high-strength material, with the high-strength material extending continuously from the first tubular connector 702 to the second tubular connector 704.

The materials of the high-strength portions 708, 710 and the signal-transparent portion 706 may be made from non- or low-magnetic/non- or low-conducting materials, and substantially of the same material (i.e., the high-strength material). The signal-transparent windows 712 are thus embedded in such material. For example, the high-strength portions 708, 710, and most of the signal-transparent portion 706, in some embodiments, may be formed from carbon-based materials (e.g., carbon fiber). Further, the signal-transparent windows 712 may be formed from signal-transparent materials, such as synthetic fibers, including, without limitation, aramids, polyether ether ether ketones (PEEK), basalts, etc.

In this illustrative embodiment, as noted, the signal-transparent portion 706 includes one or more signal-transparent windows 712 that are embedded within material of the signal-transparent tubular 700. The signal-transparent windows 712 may be arranged proximate to one or more sensors of the signal-transparent tubular 700 (e.g., arranged as shown in FIG. 4). The shape, size, geometry, orientation relative to tool axis, etc. may be selected for each signal-transparent window 712 and a respective one or more sensors within the signal-transparent portion 706. Further, in some non-limiting embodiments, the sensors or parts of the sensors may be embedded into the material of the signal-transparent windows 712.

The material of the signal-transparent windows 712 may be selected to be transparent to one or more types of sensors. For example, the material may be selected to be transparent to a single quantum particle (e.g., x-rays, gamma rays, alpha rays, beta rays, and/or other electromagnetic radiation, acoustic radiation, etc.) or to multiple types of quantum radiation or particles.

Figure 8:
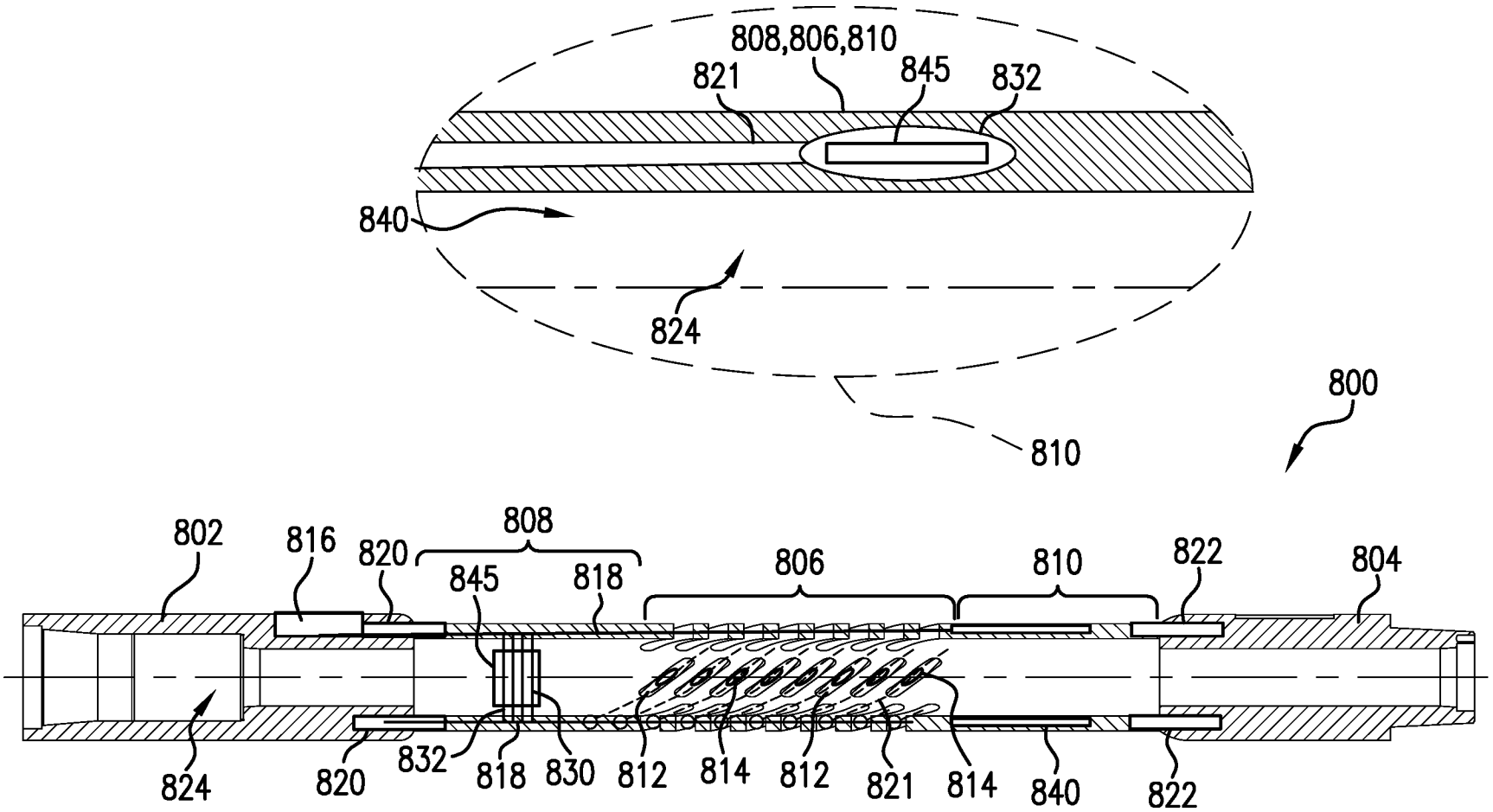
FIG. 8 is a schematic illustration of a signal-transparent tubular in accordance with an embodiment of the present disclosure.

Turning now to FIG. 8, a schematic cross-sectional illustration of a signal-transparent tubular 800 in accordance with an embodiment of the present disclosure is shown. The signal-transparent tubular 800 may be substantially similar to that shown and described above with respect to FIG. 7, and may be a section of drilling tubular, liner, casing, or other downhole tubular. The signal-transparent tubular 800 includes a first tubular connector 802 and a second tubular connector 804 arranged at opposite ends of the signal-transparent tubular 800. Between the first tubular connector 802 and the second tubular connector 804 is a signal-transparent portion 806, having signal-transparent windows 812, a first high-strength portion 808, and a second high-strength portion 810. Similar to that shown and described in FIG. 7, the signal-transparent portion 806, the first high-strength portion 808, and the second high-strength portion 810 are substantially unitary with high-strength material extending substantially continuously between the tubular connectors 802, 804.

As shown, in this embodiment, each signal-transparent window 812 includes an embedded sensor 814. The embedded sensors 814 may be of various types, such as sensors for electric and/or magnetic fields that would benefit from the electric and/or magnetic properties of the material of the signal-transparent tubular 800. Alternatively, or in addition, the embedded sensors 814 may be sensitive to nuclear radiation and/or acoustic waves. The embedded sensors may include or incorporate one or more combinations of sensors/detectors, such as a magnetic field sensor (magnetometer) and/or a gravity sensor (accelerometer) in combination with one or more of a sensor that is sensitive to electromagnetic fields, acoustic waves, and/or nuclear radiation. Such a combination may enable an ability to sense or detect a formation property in various directions and to determine the direction of the sensing at the time. Advantageously, from such a data set, images of the formation surrounding the borehole can be determined. In an alternate embodiment, one or more signal-transparent windows 812 may include one or more of a transponder, a repeater, a receiver, a transmitter, an actuator, a responder that alone or in combination may be used to transmit, receive, repeat, or respond to signals from or to one location downhole to or from another location downhole or from or to one location downhole to or from a location at the surface. Those of skill in the art will appreciate that transponders, repeaters, receivers, or responders will include sensors configured to receive signals that are to be transmitted, repeated, or responded to.

In one non-limiting embodiment, the sensors 814 may be sensitive to vibration, such as accelerometers, vibration sensors, or similar. Vibration sensitive sensors may be connected to actuators (not shown) that are configured to actuate and dampen or decrease vibration based on the measurements of the vibration sensitive sensors. Alternatively, or in addition, the windows 812 in the signal-transparent tubular 800 may be filled with vibration dampening materials, such as elastomer. In one non-limiting embodiment, vibration sensitive sensors and/or actuators may be at least partially included (e.g., embedded) within the vibration dampening material within the windows 812.

The sensors 814 (inclusive of detectors, transponders, repeaters, receivers, transmitters, actuators, responders, etc.) may be electrically connected to a controller 816 by an electrical connection 818. As shown in FIG. 8, the electrical connection 818 may be terminated within the signal-transparent tubular 800. Alternatively, or in addition, the electrical connection may terminate at the ends of the signal-transparent tubular, so as to connect to corresponding electrical connections to subs, tubes, pipes, or BHA segments (e.g., by connectors, contact rings, means for inductive, capacitive, or electromagnetic resonant coupling, etc.) that are connected to the signal-transparent tubular 800 above or below the signal-transparent tubular 800.

The electrical connection 818 may provide power and/or data communication to the sensors 814, such as between the sensors 814 and the controller 816 and/or to/from a location outside the signal-transparent tubular 800. The electrical connection 818 may include a metallic conduit. For example, the electrical connection 818 may include a wire or bus or a more complex arrangement (e.g., a circuit, such as a flexible circuit harness or a flexible circuit board). In one non-limiting embodiment, more than one sensor may be connected to the electrical connection 818 by multiple electrical lines 821 that branch from the electrical connection 818 to provide power and/or data to or from the sensors 814. As another example, a more complex arrangement may include additional components such as amplifiers, analog-digital converters, resistors, capacitors, inductors, etc.

In some embodiments, the electrical connection 818 may be installed or arranged within the composite material of the signal-transparent tubular 800 or a wall of the signal-transparent tubular 800 and/or in direct contact with the composite material of the signal-transparent tubular 800 or the wall of the signal-transparent tubular 800. The electrical connection 818 may only be partially in direct contact with the composite material of the signal-transparent tubular 800 or the wall of the signal-transparent tubular 800 (e.g., only portions of the electrical connection 818 may be in direct contact with the composite material of the signal-transparent tubular 800 or the wall of the signal-transparent tubular 800) or the electrical connection 818 may be completely in direct contact with the material of the composite material of the signal-transparent tubular 800 or the wall of the signal-transparent tubular 800. In such an embodiment, no portion of the one or more surfaces of the electrical connection 818 is in contact with anything but the material of the signal-transparent tubular 800 or the wall of the signal-transparent tubular 800.

In some embodiments, the electrical connection 818 may be embedded into the composite material of the signal-transparent tubular 800 or the wall of the signal-transparent tubular 800. For example, an electrical connection, such as a wire, a harness, or a circuit board may be embedded into the composite material of the signal-transparent tubular 800 or the wall of the signal-transparent tubular 800 by vacuum injection processing, hand lay-up, wet compression molding, pultrusion, or winding. In some embodiments, and as shown, a sensor 830 may be provided that includes at least a portion of the wire, the harness, or the circuit board that is embedded into the composite material of the signal-transparent tubular 800 or the wall of the signal-transparent tubular 800. For example, an electrical conduit may be arranged and configured to effectively act as an electrode, such as an electrode to measure voltages and/or currents. In one embodiment, if the signal-transparent tubular 800 is utilized as an electromagnetic telemetry tool, the tubular connectors 802, 804 may act as electrodes for the electromagnetic telemetry tool. Alternatively, separate electrodes (not shown) may be included in the signal-transparent tubular 800.

Advantageously, electrodes of the electromagnetic telemetry tool may be connected by the electrical connection 818 to provide means via a voltage or power supply (not shown) that may be connected to or included in the controller 816 to provide and/or control a power or voltage difference to the electrodes of the electromagnetic telemetry tool. As known in the art, electromagnetic telemetry tools benefit from a large distance between electrodes where the material between the electrodes is not conductive or is low conductive (e.g., less conductive than the material of the electrodes, e.g., 100 or 10,000 times less conductive than the material of the electrodes). This can be easily accomplished by one or more of the portions 808, 810, and 806. For example, the distance of metallic electrodes that are separated by non-conductive or low-conductive material may be larger than 10 cm, such as larger than 1 m. In other words, the distance of metallic electrodes that are separated by non-conductive or low-conductive material may be more than 30%, 50%, or even 70% of the length of the signal-transparent tubular 800.

Alternatively, in some embodiments, the wire may be wound in one or more turns 832 (shown in FIG. 8) within the composite material of the signal-transparent tubular 800 or the wall of the signal-transparent tubular 800 to effectively act as an antenna coil 830 or an antenna toroid 840 (FIG. 8 and inset illustration thereof), such as a coil/toroid that is embedded in and/or surrounded by the composite material of the signal-transparent tubular 800 or the wall of the signal-transparent tubular 800. In such an approach, the signal-transparent tubular 800 or the wall of the signal-transparent tubular 800 may include magnetic material or cores 845, such as hard magnetic material or soft magnetic material (e.g., ferrites) that are arranged and configured to guide magnetic field lines that are created by electrical current flowing through the antenna coil 830 and/or the antenna toroid 840. The controller 816 may further be connected to various other electronics to enable the storage, transmission, and/or processing of data and/or information obtained at the sensors 814. Alternatively, in some embodiments, the controller 816 may be directly configured to store, transmit, and/or process data and/or information obtained from the sensors 814 (e.g., the control 816 can include electronic storage media, processors, transceivers, and the like).

The configuration shown in FIG. 8 also illustrates a connection between the high-strength portions 808, 810 and the respective tubular connectors 802, 804. In this illustrative embodiment, the connection between the high-strength portions 808, 810 and the respective tubular connectors 802, 804 is by clamping mechanisms 820, 822. The clamping mechanisms 820, 822 may fixedly connect to one or both of the high-strength portions 808, 810 and the respective tubular connectors 802, 804. Alternatively, or in addition, the connection between the high-strength portions 808, 810 and the respective tubular connectors 802, 804 may be by welding to or fastening to form a rigid and fixedly connected signal-transparent tubular 800. The connections provided by the clamping mechanisms 820, 822 (or other types of attachment mechanisms) are sufficiently structural strong to enable the transmission of torque and weight from one part to another and thus enable active drilling operations to be used by a drill string that the signal-transparent tubular 800 is a part of.

Because the signal-transparent tubular 800 may be a portion of a drill string, the signal-transparent tubular 800 defines a flow path 824 therethrough. The flow path 824 of the signal-transparent tubular 800 passes through the first tubular connector 802, the first high-strength portion 808, the signal-transparent portion 806, the second high-strength portion 810, and the second tubular connector 804. As discussed above, a drilling mud may be conveyed through the signal-transparent tubular 800. Accordingly, the drilling mud, during operation, may directly contact the materials of the tubular connectors 802, 804, the high-strength portions 808, 810, and the sensor-portion 806. That is, in some embodiments, the sensor-portion 806 may directly form a portion of the signal-transparent tubular 800 that includes the flow path 824.

Although described above with respect to sensors and signal-transparent portions of a drill string section (e.g., drilling tubular) or other downhole tubular, such description is not to be limiting. For example, the above described sensors may be combined with and/or replaced by actuators, and the transparent portions may be actuator-transparent portions that are used to form an actuator-transparent downhole tubular. In such embodiments, the actuators may be piezo-actuators/sensors, high frequency electromagnets, magnetostrictive actuators, bio-actuators, etc. In some such embodiments, the actuators can provide sensor displacement compensation or provide constructive or destructive interference conditions during sensor displacement/movement. Further, in some embodiments, wave manipulators (e.g., corners, gaps, double gaps, etc.) with the natural frequency of wave fields may be employed. In some such examples, a comparison of the measured versus the predicted wave forms may be performed, with the predicted wave form being the actuator frequency, with adaptive screening of interference ranges being used. The transparent portions of the actuator-transparent tubular may be transparent to a characteristic or property of the respective actuator.

Further, in some embodiments and configurations, a signal-transparent tubular may be connected to an actuator-transparent tubular to form a section of a drill string. In some such embodiments, the actuator of the actuator-transparent tubular may be selected and configured to interfere or otherwise interact with a sensor of a signal-transparent tubular. Electrostriction (Piezo effect) is a property of electrical non-conductors, or dielectrics, which causes them to change shape under the application of an electric field very fast. Device that employ the magnetostrictive effect can convert magnetic energy into kinetic energy, or the reverse, for high frequency applications as well. The different types of actuators (e.g., piezo-actuators, high frequency electromagnets, magnetostrictive actuators, bio-actuators, etc.) may be used to manipulate the probability of functions to disconnect the measurement result from the measurement itself (i.e., quantum entanglement) and/or may be used to transmit/absorb defined quantum particles at defined frequencies to/from a formation. This may be achieved through the implementation of the embodiments shown and described in FIG. 6 or variations thereof.

One option for composite tubular connectors that may be employed with embodiments of the present disclosure are presented in U.S. Pat. No. 10,221,632, entitled "Composite Isolation Joint for Gap Sub or Internal Gap," issued on Mar. 5, 2019, and incorporated herein in its entirety. Some non-conductive composite materials may have a lower strength than conductive composites, like carbon fiber-based composites. In accordance with some embodiments of the present disclosure, high strength conductive composite material may be connected to stainless steel collars or connectors, for example, non-magnetic steel collars or connectors, and the conductive composite may be connected to a non-conductive composite section, separately. Such separate connections may deliver an increased mechanical strength and vibration resistance for downhole applications.

Figure 9:
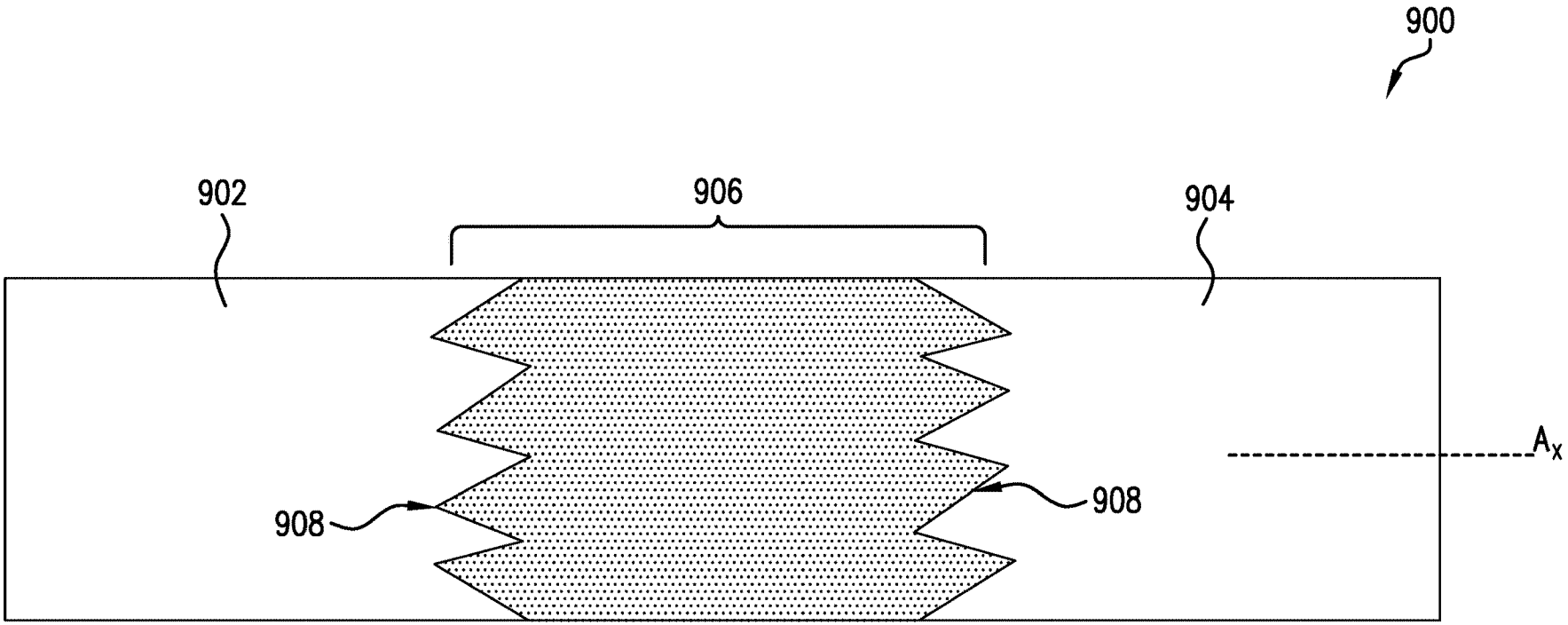
FIG. 9 is a schematic illustration of a signal-transparent tubular in accordance with an embodiment of the present disclosure.

Turning now to FIG. 9, a schematic illustration of an alternative connection that may be employed with a signal-transparent tubular 900 in accordance with an embodiment of the present disclosure is shown. The signal-transparent tubular 900 may be any type of downhole tubular, including, without limitation, drilling tubulars, liners, and casings. In FIG. 9, the signal-transparent tubular 900 includes a first tubular connector 902 and a second tubular connector 904 arranged at opposite ends of the signal-transparent tubular 900. Between the first tubular connector 902 and the second tubular connector 904 is a signal-transparent portion 906. A shaped-transition 908 (e.g. a "crown" shape) is formed between the signal-transparent portion 906 and the first and second tubular connectors 902, 904 that includes one or more contact areas where the signal-transparent portion 906 and the first or second tubular connectors 902, 904 are in contact, wherein the one or more contact areas are non-perpendicular and/or non-parallel to a length axis ($A_x$) of the tool to provide for improved torque transmission. The shaped-transition 908 may provide, for example, a connection between a composite and an anodized titanium collar or between a conductive and a non-conductive composite. The crown or other geometric shaped-transition 908 can provide an increased surface area of the transition for bonding materials, such as adhesives, and can add flexibility and high frequency torsional vibration (HFTO) dampening functionality to the signal-transparent tubular 900.

As discussed above, embodiments of the present disclosure are directed to signal-transparent tubulars. The signal-transparent tubulars can include sensors installed in or embedded within material of the signal-transparent tubular. Advantageously, embodiments described herein can provide for improved sensing in downhole operations without the need for a separate sensor-sub or component along a drill string. Further, advantageously, embodiments described herein enable the ability to locate one or more sensors at any desired location along a drill string, because the signal-transparent tubulars are functional as part of the drill string itself, and thus enable transmission of torque and other forces downhole during drilling operations.

Further, advantageously, in accordance with some embodiments, the combination of non-magnetic drill pipe tool joints, carbon fiber composites, and non-conductive glass fiber composite drill string elements enables cost effective and high resolution ray measurements (e.g., alpha-, beta-, gamma-, x-ray, and other quantum particles). Such signal-transparent tubular enable relatively simple and cost effective measurement-while-drilling and/or logging-while-drilling probe designs. Moreover, as discussed above, the signal-transparent tubulars may provide for electric insulation, and thus enables the use of electromagnetic telemetry (i.e., the signal-transparent tubular may operate as a dipole antenna gap sub). Furthermore, according to some embodiments, the materials of the signal-transparent portions and the high-strength portions can enable a low weight, high flexibility section of drill string, which can enable high build rate operations.

While embodiments described herein have been described with reference to specific figures, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed, but that the present disclosure will include all embodiments falling within the scope of the appended claims or the following description of possible embodiments.

Embodiment 1: A signal-transparent tubular for use in downhole operations, the signal-transparent tubular comprising: a tubular connector configured to engage with and connect to a different downhole tubular, the tubular connector formed from metal; a signal-transparent portion connected to the tubular connector, the signal-transparent portion formed from a composite material; and at least one of a sensor, an actuator, and a transmitter arranged within the signal-transparent portion and at least partially surrounded by the composite material, wherein the composite material of the signal-transparent portion is selected to be transparent to a characteristic of a signal that is detectable by or transmitted by the at least one sensor, actuator, and/or transmitter.

Embodiment 2: The signal-transparent tubular of any preceding embodiment, wherein the sensor is embedded within the composite material.

Embodiment 3: The signal-transparent tubular of any preceding embodiment, wherein the signal-transparent portion is at least partially made from one of aramid, basalt, glass, ceramic, fiber composites, and fibers embedded in at least one of adhesives, thermoset, thermoplastic binder, elastomeric binder, epoxide polyether ketone ketones, and polyether ether ether ketones.

Embodiment 4: The signal-transparent tubular of any preceding embodiment, wherein a magnetic permeability of the metal is less than 10.

Embodiment 5: The signal-transparent tubular of any preceding embodiment, wherein at least a part of the signal-transparent portion has a conductivity that is lower than a conductivity of the metal.

Embodiment 6: The signal-transparent tubular of any preceding embodiment, wherein the signal-transparent portion includes a window in an outer wall of the signal-transparent portion.

Embodiment 7: The signal-transparent tubular of any preceding embodiment, wherein an electrical conduit is arranged within the composite material.

Embodiment 8: The signal-transparent tubular of any preceding embodiment, wherein the electrical conduit is part of at least one of an antenna, a toroid, and an electrode.

Embodiment 9: The signal-transparent tubular of any preceding embodiment, wherein the electrical conduit is part of an electrical circuit that is arranged within the composite material.

Embodiment 10: The signal-transparent tubular of any preceding embodiment, wherein the signal-transparent tubular further comprises a magnetometer.

Embodiment 11: The signal-transparent tubular of any preceding embodiment, wherein the at least one sensor, actuator, and transmitter is configured to sense or transmit at least one of an electromagnetic signal, an acoustic signal, and a nuclear signal.

Embodiment 12: The signal-transparent tubular of any preceding embodiment, wherein the composite material is a low conductive material and the signal of the respective transmitter is configured to transmit information by electromagnetic telemetry.

Embodiment 13: A method making a signal-transparent tubular for use in downhole operations, the method comprising: connecting a tubular connector to a signal-transparent portion to form the signal-transparent tubular, wherein the tubular connector is configured to connect to a different downhole tubular, wherein the tubular connector formed from metal and wherein the signal-transparent portion is formed from a composite material; and arranging at least one of a sensor, an actuator, and a transmitter within the signal-transparent portion, the at least one sensor, actuator, or transmitter at least partially surrounded by the composite material, wherein the composite material of the signal-transparent portion is selected to be transparent to a characteristic of a signal that is detectable by or transmitted by the at least one sensor, actuator, and/or transmitter.

Embodiment 14: The method of any preceding embodiment, wherein the sensor is embedded within the composite material.

Embodiment 15: The method of any preceding embodiment, wherein the signal-transparent portion is at least partially made from one of aramid, basalt, glass, ceramic, fiber composites, and fibers embedded in at least one of adhesives, thermoset, thermoplastic binder, elastomeric binder, epoxide polyether ketone ketones, and polyether ether ether ketones.

Embodiment 16: The method of any preceding embodiment, wherein a magnetic permeability of the metal is less than 10.

Embodiment 17: The method of any preceding embodiment, wherein at least a part of the signal-transparent portion has a conductivity that is lower than a conductivity of the metal.

Embodiment 18: The method of any preceding embodiment, wherein the signal-transparent portion includes a window in an outer wall of the signal-transparent portion.

Embodiment 19: The method of any preceding embodiment, wherein an electrical conduit is arranged within the composite material.

Embodiment 20: The method of any preceding embodiment, wherein the composite material is a low conductive material and the signal of the respective transmitter is configured to transmit information by electromagnetic telemetry.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively, or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description but are only limited by the scope of the appended claims.

What is claimed:

1. A signal-transparent tubular for use in a borehole, the signal-transparent tubular comprising:

a tubular connector configured to engage with and connect to a different downhole tubular, the tubular connector formed from metal;

a signal-transparent portion, formed from a first composite material;

a high strength portion between the signal-transparent portion and the tubular connector, wherein the high strength portion is made of a second composite material configured to withstand clamping and bending loads at one or more clamping elements of the tubular connector; and at least one of a sensor, an actuator, or a transmitter arranged within the signal-transparent portion and at least partially surrounded by the first composite material, wherein the first composite material of the signal-transparent portion is selected to be transparent to a characteristic of a signal that is detectable by or transmitted by the at least one sensor, actuator, and/or transmitter.

2. The signal-transparent tubular of claim 1, wherein the signal-transparent portion is at least partially made from one of aramid, basalt, glass, ceramic, fiber composites, and fibers embedded in at least one of adhesives, thermoset, thermoplastic binder, elastomeric binder, epoxide polyether ketone ketones, or polyether ether ketones.

3. The signal-transparent tubular of claim 1, wherein a magnetic permeability of the metal is less than 10.

4. The signal-transparent tubular of claim 1, wherein at least a part of the signal-transparent portion has a conductivity that is lower than a conductivity of the metal.

5. The signal-transparent tubular of claim 1, wherein the signal-transparent portion includes a window in an outer wall of the signal-transparent portion.

6. The signal-transparent tubular of claim 1, wherein an electrical conduit is arranged within the first composite material.

7. The signal-transparent tubular of claim 6, wherein the electrical conduit is part of at least one of an antenna, a coil, a toroid, an electrode, or an electrical circuit that is arranged within the first composite material.

8. The signal-transparent tubular of claim 1, wherein the signal-transparent portion comprises:

a first composite portion connected to the tubular connector, a signal-transparent section extending from the first composite portion, and a second composite portion extending from an end of the signal-transparent section opposite from the first composite portion.

9. The signal-transparent tubular of claim 1, wherein the signal-transparent portion further comprises a magnetometer.

10. The signal-transparent tubular of claim 1, wherein the at least one sensor, actuator, or transmitter is configured to detect or transmit at least one of an electromagnetic signal, an acoustic signal, or a nuclear signal.

11. The signal-transparent tubular of claim 1, wherein the first composite material is a low conductive material and the signal of the respective transmitter is configured to transmit information by electromagnetic telemetry.

12. The signal-transparent tubular of claim 1, wherein a first outer diameter of the high strength portion is less than a second outer diameter of the tubular connector.

13. The signal-transparent tubular of claim 1, wherein the sensor is embedded within the first composite material.

14. The signal-transparent tubular of claim 1, wherein the high strength portion is attached to the signal-transparent tubular and connects the signal-transparent tubular to the tubular connector.

15. A signal-transparent tubular for use in a borehole, the signal-transparent tubular comprising:

a tubular connector configured to engage with and connect to a different downhole tubular, the tubular connector formed from metal;

a signal-transparent portion in direct contact with a drilling mud that is circulated in an annular space between the signal-transparent tubular and a wall of the borehole, the signal-transparent portion formed from a first composite material;

a high strength portion between the signal-transparent portion and the tubular connector, wherein the high strength portion is made of a second composite material configured to withstand clamping and bending loads at one or more clamping elements of the tubular connector; and at least one of a sensor, an actuator, or a transmitter arranged within the signal-transparent portion and at least partially surrounded by the first composite material, wherein the first composite material of the signal-transparent portion is selected to be transparent to a characteristic of a signal that is detectable by or transmitted by the at least one sensor, actuator, and/or transmitter.

16. A method of making a signal-transparent tubular for use in a borehole, the method comprising:

connecting a tubular connector to a high strength portion, wherein the tubular connector is configured to connect to a different downhole tubular, wherein the tubular connector is formed from metal;

connecting the high strength portion to a signal-transparent portion with the high strength portion between the signal-transparent portion and the tubular connector, wherein the signal-transparent portion is formed from a first composite material and the high strength portion is made of a second composite material configured to withstand clamping and bending loads at one or more clamping elements of the tubular connector; and arranging at least one of a sensor, an actuator, or a transmitter within the signal-transparent portion, the at least one sensor, actuator, or transmitter at least partially surrounded by the first composite material, wherein the first composite material of the signal-transparent portion is selected to be transparent to a characteristic of a signal that is detectable by or transmitted by the at least one sensor, actuator, and/or transmitter.

17. The method of claim 16, wherein the signal-transparent portion is at least partially made from one of aramid, basalt, glass, ceramic, fiber composites, and fibers embedded in at least one of adhesives, thermoset, thermoplastic binder, elastomeric binder, epoxide polyether ketone ketones, or polyether ether ketones.

18. The method of claim 16, wherein a magnetic permeability of the metal is less than 10.

19. The method of claim 16, wherein at least a part of the signal-transparent portion has a conductivity that is lower than a conductivity of the metal.

20. The method of claim 16, wherein the signal-transparent portion includes a window in an outer wall of the signal-transparent portion.

21. The method of claim 16, wherein an electrical conduit is arranged within the first composite material.

22. The method of claim 16, wherein the first composite material is a low conductive material and the signal of the respective transmitter is configured to transmit information by electromagnetic telemetry.

23. The method of claim 16, wherein the sensor is embedded within the first composite material.

24. The method of claim 16, further comprising attaching the signal-transparent tubular to connect the signal-transparent tubular to the tubular connector.

25. A method of making a signal-transparent tubular for use in a borehole, the method comprising:

connecting a tubular connector to a high strength portion, wherein the tubular connector is configured to connect to a different downhole tubular, wherein the tubular connector is formed from metal;

connecting the high strength portion to a signal-transparent portion with the high strength portion between the signal-transparent portion and the tubular connector, wherein the signal-transparent portion is formed from a first composite material and the high strength portion is made of a second composite material configured to withstand clamping and bending loads at one or more clamping elements of the tubular connector, and the signal-transparent portion is in direct contact with a drilling mud that is circulated in an annular space between the signal-transparent tubular and the borehole; and arranging at least one of a sensor, an actuator, or a transmitter within the signal-transparent portion, the at least one sensor, actuator, or transmitter at least partially surrounded by the first composite material, wherein the first composite material of the signal-transparent portion is selected to be transparent to a characteristic of a signal that is detectable by or transmitted by the at least one sensor, actuator, and/or transmitter.

* * * * *